US012491422B2

(12) United States Patent
Patel

(10) Patent No.: US 12,491,422 B2
(45) Date of Patent: Dec. 9, 2025

(54) MODULAR GOLF MATS AND METHODS FOR THE ASSEMBLY THEREOF

(71) Applicant: Dhilan Patel, Humble, TX (US)

(72) Inventor: Dhilan Patel, Humble, TX (US)

( * ) Notice: Subject to any disclaimer, the term of this patent is extended or adjusted under 35 U.S.C. 154(b) by 0 days.

(21) Appl. No.: 19/171,768

(22) Filed: Apr. 7, 2025

(65) Prior Publication Data

US 2025/0319378 A1 Oct. 16, 2025

Related U.S. Application Data

(60) Provisional application No. 63/634,800, filed on Apr. 16, 2024.

(51) Int. Cl.
*A63B 69/36* (2006.01)

(52) U.S. Cl.
CPC ..... *A63B 69/3661* (2013.01)

(58) Field of Classification Search
CPC ..... A63B 69/3661
USPC ..... 473/150, 153, 160, 162, 195, 278, 279, 473/409
See application file for complete search history.

(56) References Cited

U.S. PATENT DOCUMENTS

| | | | | |
|---|---|---|---|---|
| 3,735,988 | A * | 5/1973 | Palmer | A63B 67/02 428/17 |
| 5,026,580 | A * | 6/1991 | Hammon | A63B 69/3661 428/17 |
| 5,042,813 | A * | 8/1991 | Huang | A63B 67/02 473/197 |
| 6,106,409 | A * | 8/2000 | Jackson, Jr. | A63B 69/3661 473/278 |
| 6,428,420 | B1 * | 8/2002 | Durnell | A63B 67/02 473/162 |
| 6,672,971 | B2 * | 1/2004 | Barlow | A63B 69/3661 473/162 |
| 9,267,244 | B2 * | 2/2016 | Bennett | E01C 13/08 |
| 2003/0096657 | A1 * | 5/2003 | Knox | A63B 67/02 473/150 |
| 2003/0190969 | A1 * | 10/2003 | Barlow | E04F 15/10 473/157 |

* cited by examiner

*Primary Examiner* — Nini F Legesse
(74) *Attorney, Agent, or Firm* — William R. Childs; Childs Patent Law PLLC

(57) ABSTRACT

The present disclosure relates to a modular golf mat that includes a floor tile and a tile connector, wherein the floor tile has a tile top, a tile side, and a tile bottom, wherein the tile top has a polygonal shape. The tile top includes a grass layer, and the tile side has a tile slot that opens to a tile cavity, wherein the tile cavity has a shape complementary to a portion of the tile connector.

12 Claims, 5 Drawing Sheets

MODULAR GOLF MATS AND METHODS FOR THE ASSEMBLY THEREOF

CROSS-REFERENCE TO RELATED APPLICATIONS

This application is a US non-provisional application and claims priority to U.S. Provisional Patent Application No. 63/634,800, entitled "MODULAR GOLF MATS AND METHODS FOR THE ASSEMBLY THEREOF," filed on Apr. 16, 2024, the entirety of which is incorporated by reference.

TECHNICAL FIELD

The present disclosure relates to modular golf mats and methods for the assembly and use thereof, wherein the modular golf mat includes a floor tile and a tile connector. A benefit of the modular golf mat can be to allow users to create a customizable golfing area. The layered construction, with a stable base, cushioning mid-layer, and realistic grass top layer, can provide durability, comfort, and a realistic or fanciful playing experience for golfers. Additionally, the interlocking mechanism of the floor tile can allow for easy assembling and disassembling of the floor tile, thereby facilitating a customizable golf course as well as easy transportation and shipping of the modular golf mat from one place to another place.

BACKGROUND

Golf is a sport that has grown from a beloved recreational sport in 15th century Scotland to men's and women's international professional golf competitions today. In 2019, there were over 38,000 golf courses around the world with over 16,000 golf courses in the USA. The market for golf equipment has been valued at 7.48 billion US dollars in 2022 and is expected to grow by about 5.0% per year through 2030.

Despite the popularity of golf, golf courses, and the development of golf equipment, it is not always convenient for avid golfers to travel to golf courses because golf courses tend to require a lot of unencumbered land and water to maintain. To keep costs down, many golf courses are found in remote locations outside of cities, towns, and vacation resorts. These remote locations can make it challenging for avid golfers to travel to golf courses as much as they would like. For serious golfers, consistent practice is needed to develop and maintain their skills.

To address this challenge, an industry of indoor and outdoor golf mats courses has developed, including the related sport of mini golf. However, most golf mats are minimal for practicing putting in an office or indoor golf facility.

An additional challenge is that there are many famed golf courses throughout the world that avid golfers would dearly love to travel to if only they had the time and money to do so.

There remains a need for a golf mat that provides solutions to these challenges. There remains a need to cost-effectively maintain and enhance the longevity and utility of golf practice mats.

SUMMARY

The present disclosure relates to a modular golf mat. In some embodiments, the modular golf mat includes a floor tile and a tile connector, wherein the floor tile has a tile top, a tile side, and a tile bottom, wherein the tile top has a polygonal shape, wherein the tile top includes a grass layer, wherein the tile side has a tile slot that opens to a tile cavity, and wherein the tile cavity has a shape complementary to a portion of the tile connector.

In some embodiments of the modular golf mat, the floor tile has 3, 4, 5, or 6 tile sides, or wherein the polygonal shape is a triangle, a rectangle, a rhombus, a pentagon, or a hexagon. In some embodiments, the tile bottom has a top polygonal shape selected from the group consisting of a triangle, a rectangle, a rhombus, a pentagon, or a hexagon. In some embodiments, the polygonal shape of the tile top and the bottom polygonal shape of the tile bottom are the same or different.

In some embodiments, the tile bottom includes a base layer, and the floor tile includes a cushioning layer located between the base layer and the grass layer. In some embodiments, the tile bottom includes a base layer, wherein at least a portion of the base layer is in contact with the cushioning layer, and wherein the cushioning layer is in contact with a portion of the grass layer.

In some embodiments, the floor tile includes a base layer, a cushioning layer, and the grass layer, and wherein the base layer has a base layer thickness of from about 0.1 cm to about 6.0 cm, or wherein the cushioning layer has a cushioning layer thickness of from about 0.1 cm to about 92.0 cm. In some embodiments, the cushioning layer has an average cushioning layer thickness of from about 0.1 cm to about 92.0 cm. In some embodiments, the grass layer has a grass layer thickness of from about 0.1 cm to about 2.6 cm.

In some embodiments, the floor tile includes a base layer, a cushioning layer, and the grass layer, and wherein the base layer includes wood, a foam, a foam composite, a plastic, a rubber, a polymer, or any combination thereof. In some embodiments, the cushioning layer includes a silicone, a foam, or a rubber, a particle infill, or any combination thereof. In some embodiments, the grass layer includes a polyethylene, a polypropylene, a nylon, or any combination thereof.

In some embodiments, the top side of the floor tile includes a coating layer on top of at least a portion of the grass layer, and wherein the coating layer has a thickness of about 0.02 cm to about 2.6 cm. In some embodiments, the coating layer includes a dye, a pigment, a paint coating, or a protective coating.

In some embodiments, the top side of the floor tile includes an obstacle layer, and wherein the obstacle layer includes one or more objects reversibly attached to the top surface of the floor tile.

In some embodiments, the modular golf mat includes an interlocking array of two or more floor tiles, wherein the two or more floor tiles have a tile top having a hexagonal shape and six tile sides having equal side lengths, and wherein the floor tile is connected by the tile connector to an adjacent floor tile, wherein a portion of the tile connector extends into the tile cavity of the floor tile and a different portion of the tile connector extends into the tile cavity of the adjacent floor tile.

In some embodiments, the tile connector has a connector length, a connector width, and a connector thickness, and the tile slot is located within the tile side, the tile slot has a slot width and a slot thickness that compliments the connector width and the connector thickness of the tile connector, and the depth of the tile cavity is equal to or less than half of the length of the tile connector.

In some embodiments, the tile connector has a connector length, a connector width, and a connector height with a protrusion on each end of the tile connector, the tile slot is formed by a bottom of the tile side, the tile slot has a slot width and a slot thickness that compliments the connector width and the connector thickness of the tile connector, the depth of the tile cavity is equal to or less than half of the connector length of the tile connector, and the tile cavity contains a recess that complements a height of the protrusion of the tile connector.

Methods of assembling a modular golf mat are disclosed herein. In some embodiments, the method includes providing a floor tile and a tile connector, wherein the floor tile has a tile top, a tile side, and a tile bottom, wherein the tile top has a polygonal shape, wherein the tile top includes a grass layer, wherein the tile side has a tile slot that opens to a tile cavity, and wherein the tile cavity has a shape complementary to a portion of the tile connector. In some embodiments, the method further includes fastening a portion of the tile connector into the tile cavity of the floor tile.

In some embodiments, the method further includes providing a second floor tile, wherein the second floor tile has a second tile top, a second tile side, and a second tile bottom, wherein the second tile top has a second polygonal shape, and wherein the second tile top includes a second grass layer, wherein the second tile side has a second tile slot that opens to a second tile cavity, wherein the second tile cavity has a shape complementary to a second portion of the tile connector, and wherein the second polygonal shape matches the polygonal shape of the floor tile.

In some embodiments, the method further includes assembling the modular golf mat by fastening the second portion of the tile connector into the second tile cavity of the second floor tile. In some embodiments, the method further includes forming an obstacle layer by attaching one or more obstacles to the tile top, the second tile top, or any combination thereof.

BRIEF DESCRIPTION OF THE DRAWINGS

The foregoing summary, as well as the following detailed description of the embodiments, will be better understood when read in conjunction with the attached drawings. For the purpose of illustration, there are shown in the drawings some embodiments, which may be preferable. It should be understood that the embodiments depicted are not limited to the precise details shown. Unless otherwise noted, the drawings are not to scale.

DETAILED DESCRIPTION

Figure 1:
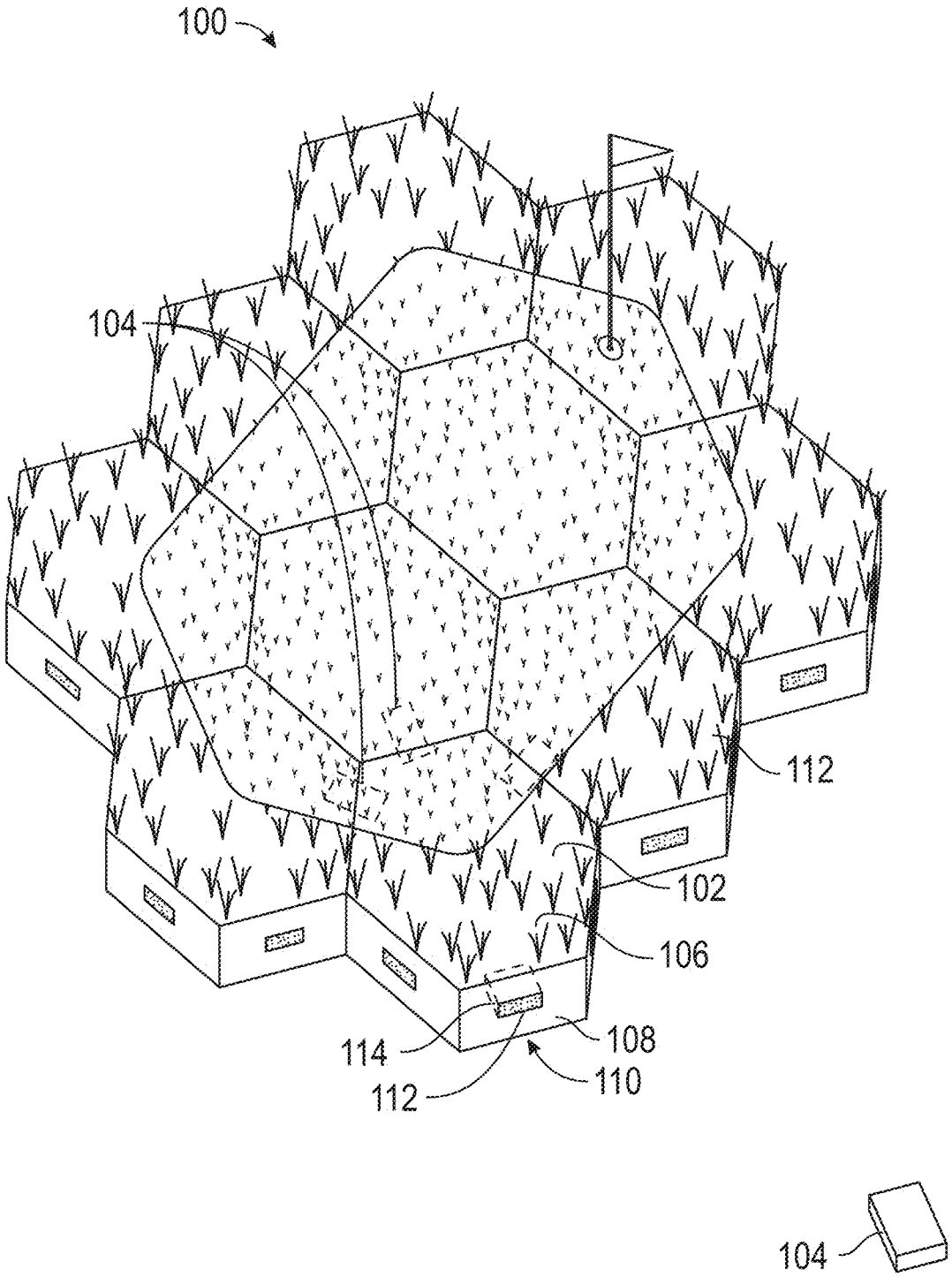
FIG. 1 is a schematic depiction of an embodiment of a modular golf mat.

Unless otherwise noted, all measurements are in standard metric units.

Unless otherwise noted, all instances of the words "a," "an," or "the" can refer to one or more than one of the word that they modify.

Unless otherwise noted, the phrase "at least one of" means one or more than one of an object. For example, the phrase "at least one of the obstacles" would mean the obstacle, multiple obstacles, or any combination or sub-combination of the obstacles.

Unless otherwise noted, the term "about" refers to ±10% of the non-percentage number that is described, rounded to the nearest number to the accuracy shown. For example, about 105.3 mm, would include 94.8 to 115.8 mm. Unless otherwise noted, the term "about" refers to ±5% of a percentage number. For example, about 20% would include 15 to 25%. When the term "about" is discussed in terms of a range, then the term refers to the appropriate amount less than the lower limit and more than the upper limit. For example, from about 100 to about 200 mm would include from 90 to 220 mm.

Unless otherwise noted, the terms "provide", "provided" or "providing" refer to the supply, production, purchase, manufacture, assembly, formation, selection, configuration, conversion, introduction, addition, or incorporation of any element, amount, component, reagent, quantity, measurement, or analysis of any method or system of any embodiment herein.

Conventional golf mats are typically constructed as single-piece units, designed to simulate the texture and resistance characteristics of a golf course surface. Traditionally, these golf mats have been crafted as single-piece units with a uniform surface intended to replicate the grass of a golf course. They were designed to provide a cheap, convenient, and simple solution for practicing putting in confined or non-grass environments, such as homes, offices, or driving ranges. The basic idea behind these conventional golf mats is to provide a cheap, one-size-fits-all solution for practicing golf. As such, many conventional golf mats are often constructed to provide a flat, unchanging surface over the entire golf mat to simulate a putting green. Other singular, isolated golf mats are often rectangular and can vary in thickness and grass blade length to provide some variation. While these conventional golf mats might serve to replicate the feel of a putting green, their lack of surface curves provides a limited simulation of real practice conditions.

Another type of conventional golf mat is a large golf mat often found in an indoor golf facility. These can have surfaces that vary greatly in terms of the contours of the surface and the grass blade length in a manner similar to that of a traditional outdoor golf course. While functional, these large conventional golf mats have limitations in terms of versatility and adaptability due to fixed dimensions and shapes. These fixed dimensions and shapes restrict the golf mats to specific sizes and shapes, which does not allow for customization or expansion. This static design limits the user's ability to recreate various playing scenarios.

Other conventional golf mats feature built-in obstacles to create a mini golf experience. These obstacles can add variety to the playing surface. However, the configuration of these golf mats usually remains unchanged once manufactured. If a golfer uses these types of golf mat, then the golfer cannot alter the layout or the complexity of the obstacles. This unchanging golf mat limits the long-term interest of the user.

Thus, one of the major challenges faced by conventional golf mats is their lack of adaptability. A fixed-size golf mat limits a golfer's practice to a narrow range of shots. This constraint prevents golfers from simulating various course conditions found on real golf courses. Further, the inability to practice different shots can restrict the usefulness of these golf mats.

Another challenge faced by traditional golf mats is their management of wear and tear. Conventional golf mats are typically constructed from a synthetic grass layer bonded to a shock-absorbent, rubberized backing. While inexpensive and functional, these single-piece mats have several drawbacks. This construction aims to offer a degree of cushioning to mimic the resistance felt on natural turf and to protect golf clubs from damage on impact. The synthetic grass tends to be highly durable, made to withstand repeated strikes from the golf clubs.

However, regardless of how durable the material used is, over time and use, certain regions of the golf mat experience more use than others. These high-use areas are subject to faster damage due to repeated impacts from golf clubs. This faster wear creates an uneven surface, which can change the golf ball's movement during practice sessions. Consequently, the practice experience loses the ability to accurately mimic the conditions encountered on an actual golf course. This degradation of the high use areas also severely impacts the overall utility and aesthetic appearances of the golf mat. Since these golf mats are constructed as one piece, when a high use section becomes worn or damaged, the entire mat often needs to be replaced, which can be costly and wasteful.

Conventional large one-piece golf mats pose significant environmental concerns. When a section becomes overly worn, users typically must replace the whole mat. Such a process is environmentally unsustainable. Disposal of these large, non-biodegradable items adds to environmental waste. This waste is not economical for consumers either, leading to increased expenses over time.

Furthermore, large conventional golf mats pose problems in transportation and storage due to their single-piece construction. These large mats are often bulky can cannot easily be moved. Their considerable size and rigidity require a significant amount of storage space. When facing space constraints, the golfers may find these golf mats impractical, which has the potential to discourage consistent practice.

A modular golf mat or golf mat system is disclosed herein which addresses these problems. Unlike conventional golf mats, a modular golf mat is capable of customizable assembly, expansion, and rearrangement. Users have the flexibility to alter the mat's configuration, creating various shape combinations and introducing different obstacles to suit their preferences or to create conditions found in a favorite mini golf course. Further, the modular golf mat can provide a personalized practice experience, with the potential to replicate the complex layouts and visual elements of famous golf courses. The modular golf mat also allows for easy replacement of parts of modules of the golf mat which become worn or damaged during use. This replaceability of a single part or module of the modular golf mat can reduce the environmental impact of the golf mat, relative to single-piece golf mats. The ability of the golf mats to be reversibly disassembled and reassembled makes transportation and storage vastly easier relative to the transportation and storage of conventional large one-piece golf mats.

One of the challenges of designing a modular golf mat is the top surface of the golf mat must be smooth with no gaps between pieces or modules of the golf mat because even the slightest gap can change the movement of the golf ball across the surface of the modular golf mat. Therefore, it has been found that many reversable fastening mechanisms, such as VELCRO™ between modules or rope, cannot provide a smooth surface between modules. Another challenge is a shape of the modules that allows for adjacent modules to be reversibly and securely fastened to each other. For example, with a square design, it can be relatively easy to fasten four adjacent modules to the four edges of the square piece. However, when trying to fasten a piece or module into the corner formed by 3 modules can prove difficult because the piece being inserted would need to be inserted angle or not fastened at all.

It has been discovered that there the modular golf mat tiles can be designed to have a mechanism that allows for tiles or modules to be reversibly attached to provide a smooth to surface. Further, it has been discovered that the modular tiles can be shaped to allow for the edges of these modules to be reversibly fastened without any gaps between the modules.

Regarding the interlocking or fastening mechanism, the disclosed modular golf mat incorporates side slots on each golf mat. In some embodiments, these slots are configured to receive a connector piece, which when inserted, secures the mat together. In some embodiments, the connection mechanism, either through friction or a hook design, is robust enough to prevent separation or misalignment during use. This feature provides a smooth and consistent playing surface, free from trip hazards such as larger holes or bumps. Additionally, the disclosed design allows for the golf mat to be disassembled and reassembled with ease, providing versatility in the mat's shape, use and storage.

The disclosed modular golf mat departs from traditional square or rectangular mat shapes to facilitate effortless lateral connections, which are not typically accommodated by traditional shapes. In some embodiments, pentagonal or hexagonal shapes are adopted, accommodating seamless assembly and the addition of connector pieces. These shapes are optimal for the interlocking design and maintain the integrity of the playing surface. In some embodiments, edge pieces may have various shapes or obstacles and may not possess interlocking receptacles on every side due to their placement at the perimeter of the modular golf mat. In some embodiments, the central pieces are equipped with slots on all sides to allow for a secure and unified golf mat ensemble.

Embodiments of a modular golf mat are disclosed herein. In some embodiments, the modular golf mat includes a floor tile and a tile connector, wherein the floor tile has a tile top, a tile side, and a tile bottom, wherein the tile top has a polygonal shape, wherein the tile top includes a grass layer, wherein the tile side has a tile slot that opens to a tile cavity, and wherein the tile cavity has a shape complementary to a portion of the tile connector.

System

Figure 3:
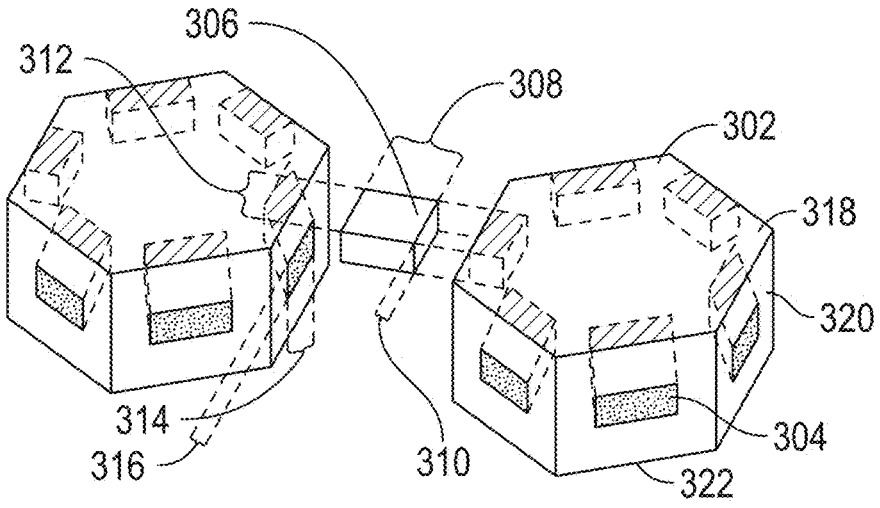
FIG. 3 is a schematic depiction of two modular floor tiles and a first connector.

In some embodiments, a modular golf mat 100 is disclosed. Referring to FIG. 1, in some embodiments, the modular golf mat 100 includes a floor tile 102 and a tile connector 104 (e.g., a first connector 306 as illustrated in FIG. 3). Referring to FIG. 1, the floor tile 102 has a tile top 106, a tile side 108, and a tile bottom 110. In some embodiments, the tile top 106 has a polygonal shape. In some embodiments, the polygon shape may be, but not limited to, a triangle, a rectangle, a square, a rhombus, a pentagon, a hexagon, a heptagon, an octagon, a nonagon, a decagon, and the like. In some embodiments, the tile top 106 includes a grass layer 116 that emulates the sensation of real turf. In some embodiments, the tile bottom 110 has a polygonal shape similar or identical to the tile top 106. This polygon shape may be any shape from a group consisting of, but not limited to, a triangle, a rectangle, a square, a rhombus, a pentagon, a hexagon, a heptagon, an octagon, a nonagon, a decagon, and any other similar shapes that match the shape of the tile top 106. In some embodiments, the polygonal shape of the tile top 106 and the polygonal shape of the tile bottom 110 are the same. In some other embodiments, the polygonal shape of the tile top 106 and the polygonal shape of the tile bottom 110 different. In an example embodiment, the tile top 106 may be configured as a hexagonal shape to enhance efficiency and surface coverage. In another example embodiment, the tile bottom 110 may be configured as a square shape to enhance stability and facilitate precise alignment with the substrate. In an example embodiment, a dual-shape approach may be extended to incorporate the tile top 106 with a triangular shape configuration to allow for versatile pattern formation, while the tile bottom 110 may be configured with a pentagonal shape, thereby optimizing load distribution and improving shock absorption. The variance in polygonal shape configurations between the tile top 106 and the tile bottom 110 allows the top surface to be optimized for interlocking and aesthetic pattern creation, while the bottom shape can be tailored for structural stability and effective load distribution.

In some embodiments, the floor tile 102 has a plurality of tile sides that may be, but not limited to, 3, 4, 5, or 6 tile slides. In an example embodiment, if the polygonal shape of the tile top 106 and the tile bottom 110 of the floor tile 102 is hexagon, the floor tile 102 may have 6 tile sides. In another example embodiment, if the polygonal shape of the tile top 106 and the tile bottom 110 of the floor tile 102 is triangle, the floor tile 102 may have 3 tile sides. In another example embodiment, if the polygonal shape of the tile top 106 and the tile bottom 110 of the floor tile 102 is rectangle, rhombus, or square, the floor tile 102 may have 4 tile sides. In another example embodiment, if the polygonal shape of the tile top 106 and the tile bottom 110 of the floor tile 102 is pentagon or rhombus, the floor tile 102 may have 5 tile sides. Therefore, the number of the tile sides may vary based on the polygonal shape of the tile top 106 and the tile bottom 110 of the floor tile 102. Referring to FIG. 1, the tile top 106 and the tile bottom 110 of the floor tile 102 are illustrated as having a hexagon shape as an exemplary embodiment.

In some embodiments, referring to FIG. 1, an array of floor tiles 102 are interconnected using tile connectors 104. The tile connectors 104 enable the assembly of multiple floor tiles 102, effectively expanding the surface of play area. In some embodiments, each floor tile 102 has a corresponding tile slot 112 (e.g., a tile slot 304 as illustrated in FIG. 3) and a tile cavity 114 to accommodate the tile connector 104 within the tile slot 112, thereby facilitating a secure and stable fit. In some embodiments, the interlocking mechanism is shaped in a manner that, upon engagement, the tile connector 104 secures the floor tile 102 in a fixed position, preventing the floor tile 102 from shifting apart under movements and activities consistent with golf practice. This modular arrangement allows for a customizable layout, where a user can easily add or remove tiles (e.g., 102) to modify the size and the shape of the overall play area to suit specific needs or preferences. The resulting interconnected surface provides a continuous, uniform area for play, which can be as large or as small as required, thereby facilitating a versatile and adaptive golf practice environment.

Figure 2:
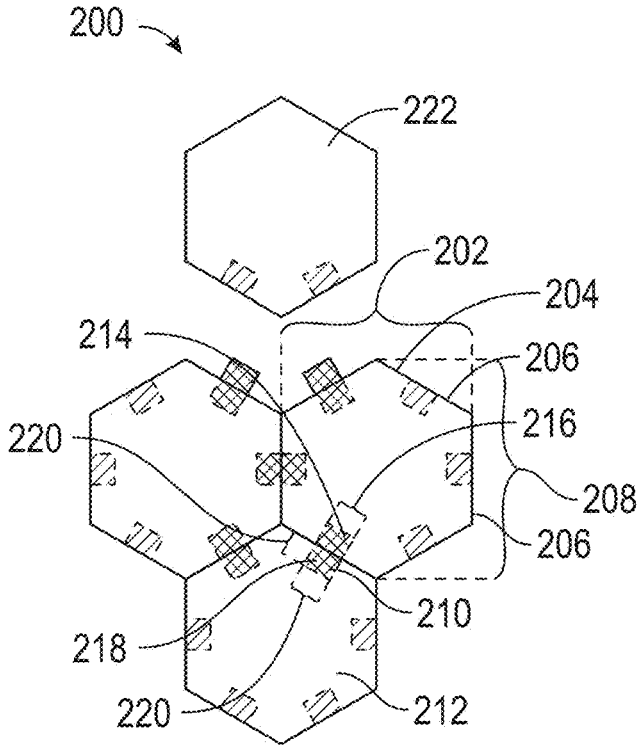
FIG. 2 is a schematic depiction of an embodiment of an interlocking array of two or more floor tiles using a tile connector, viewed from the top down.

Referring to FIG. 2, in some embodiments, the modular golf mat (e.g., 100 as illustrated in FIG. 1) includes an interlocking array 200 of two or more floor tiles 202. The two or more floor tiles 202 have the tile top (e.g., 106 as illustrated in FIG. 1) and the tile bottom 204. For illustrative purposes, each tile top has a hexagonal shape 208, thereby providing that each of the floor tiles 202 has six tile sides 206 with equal side lengths. It may be appreciated that other configurations and/or shapes of the tile top are possible within the scope of the present disclosure.

In some embodiments, each tile side 206 of the floor tile 202 has the tile slot (e.g., 304 as illustrated in FIG. 3) that opens to the tile cavity 216. In some embodiments, the tile cavity 216 has a shape complementary to a portion of the tile connector 214. In some embodiments, each floor tile 202 is connected by the first tile connector 210 to an adjacent floor tile 212. In these embodiments, the portion of the tile connector 214 extends into the tile cavity 216 of the floor tile 202 and a different portion of the tile connector 218 extends into the tile cavity of the adjacent floor tile 220.

Referring to FIG. 2, a tile floor edge piece 222 has six sides, where two sides can interlock with the array of the interlocked floor tiles which is adjacent to the tile floor edge piece 222 using the tile connector 210. One side of the tile floor edge piece 222 can interlock with at least one of the floor tiles in the array of the floor tiles and another side of the tile floor edge piece 222 can interlock with at least one other floor tile in the array of the floor tiles. In some embodiments, another side of the tile floor edge piece 222 is configured with a plane border without the tile slot (e.g., 112 as illustrated in FIG. 1), thereby providing a neat finish to the outer boundaries of the array of floor tiles. The hexagonal shape of the floor tiles 202 facilitates efficient and aesthetic arrangements, allowing the tile floor edge piece 222 to integrate seamlessly into the overall pattern.

Referring to FIG. 3, in some embodiments, the first tile connector 306 is configured with various dimensions such as a connector length 308, a connector width 312, a connector thickness (not shown), and a connector height 310. The floor tile 302 includes the tile slot 304 which is located within the tile side 320. In some embodiments, the tile slot 304 has a tile slot width 314, a tile slot thickness (not shown), and a tile slot height 316 that compliments the connector width 312, the connector thickness, and the connector height 310, respectively. In these embodiments, a depth of the tile cavity (e.g., 114 as illustrated in FIG. 1) is equal to or less than half of the length of the first tile connector 306. In an example embodiment, if the connector length 308 is 5 cm, the connector width 312 is 2 cm, the connector thickness is 1 cm, and the connector height 310 is 0.5 cm, the tile slot width 314 is 2 cm to match the connector width 312, the tile slot thickness 316 is 1 cm to accommodate the connector thickness, and the tile slot height 316 is 0.5 cm to align with the connector height 310. In some embodiments, the depth of the tile cavity 114 is crafted to be no more than half of the connector length 308, which in this example embodiment may be 2.5 cm or less. This configuration provides enough grip for stability while also allowing for the easy assembly and disassembly of the floor tiles 302. In some embodiments, the first tile connector 306 is referred to as a bridge, merging two-floor tiles into a uniform plane. In some embodiments, the first tile connector 306 and the tile slot 304 have dimensions suitable to create an integrated bond, when the tiles 302 are positioned together, thereby providing a smooth and an even surface, which is essential for the modular golf mat (e.g., 100) to accurately simulate the level terrain needed for the game. In some embodiments, disassembling the modular golf mat 100 requires reversing the assembly process, where the first tile connectors 306 are disengaged from the tile slots 304 of adjacent tiles. Each first tile connector 306 may be extracted in a manner that does not damage the interlocking mechanisms to such that the first tile connectors 306 remain functional for future reassembly. The configuration of the first tile connectors 306 and the tile slots 304 is typically such that disassembly is straightforward, allowing for quick breakdown and efficient storage or transport.

In some embodiments, the configuration of the tile slot 304 and the corresponding first tile connector 306 facilitating seamless interlocking to produce a stable and an even playing surface. In some embodiments, the tile slot 304 may be of various shapes such as, but not limited to, a square cavity, a round cavity, a dovetail cavity, a T-shaped cavity, and the like, each configured to correspond with a specific shape of the first tile connector 306. In some embodiments, the first tile connector 306 may be crafted to match or complement the shape of the tile slot 304, with possible shapes including, but not limited to, square pegs, round pegs, dovetail prongs, T-shaped protrusions, and the like, facilitating a snug and secure fit. In some embodiments, the shape of the tile slot 304 and the first tile connector 306 can be such that it features interlocking patterns like puzzle pieces, hexagonal, octagonal, or gear-shaped for multi-directional interlocking capabilities. The configuration of the tile slot 304 and the corresponding first tile connector 306 can be selected based on the assembly and disassembly case, as well as the load-bearing demands of the modular golf mat 100. In FIG. 3, the tile top is referred to as 318, and the tile bottom is referred to as 322.

Figure 4:
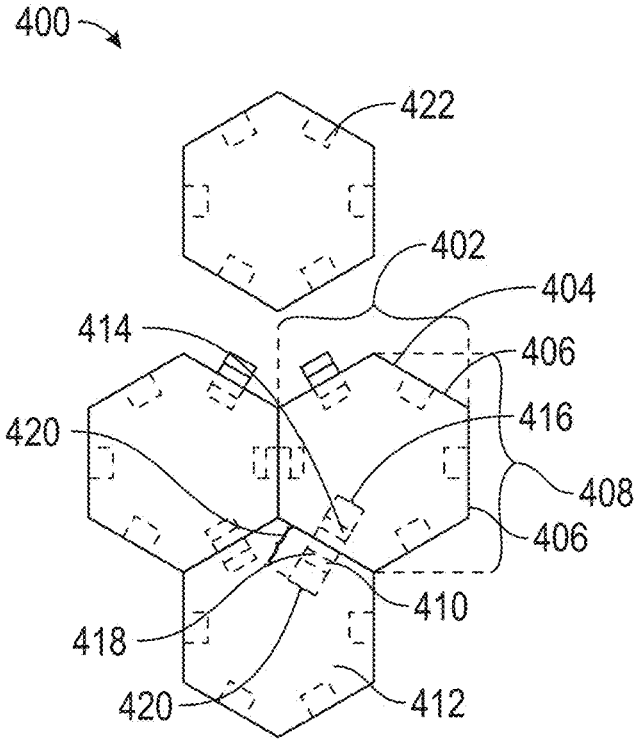
FIG. 4 is a schematic depiction of an embodiment of an interlocking array of two or more floor tiles using a second connector, viewed from the top down.
Figure 5:
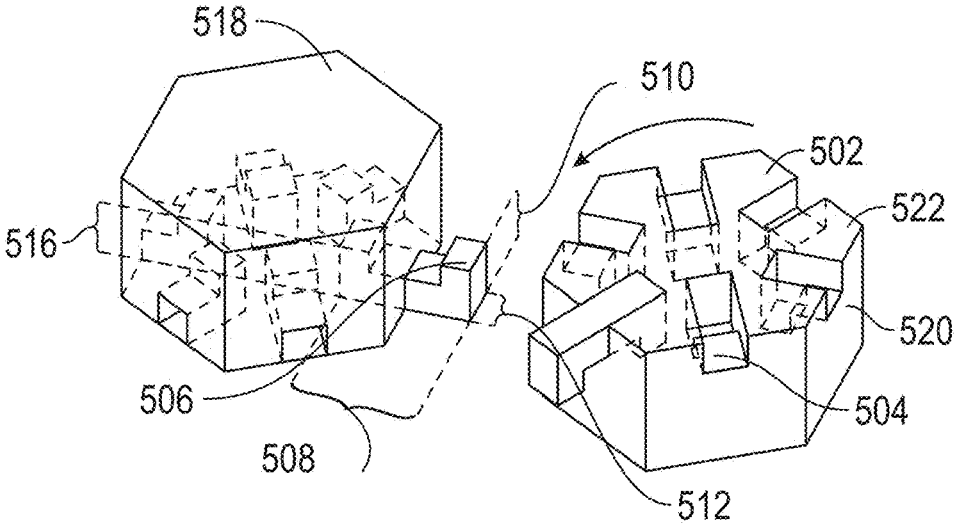
FIG. 5 is a schematic depiction of two modular floor tiles and a second connector.

Referring to FIG. 4, in some embodiments, the modular golf mat (e.g., 100 as illustrated in FIG. 1) includes an interlocking array 400 of two or more floor tiles 402. The two or more floor tiles 402 have the tile top (e.g., 106 as illustrated in FIG. 1) and the tile bottom 404. For illustrative purposes, each tile top has a hexagonal shape 408, thereby providing a floor tile 402 having six tile sides 406 with equal side lengths. In some embodiments, each tile side 406 of the floor tile 402 has the tile slot (e.g., 504 as illustrated in FIG. 5) that opens to the tile cavity 416. In some embodiments, the tile cavity 416 has a shape complementary to a portion of the tile connector 414. In some embodiments, each floor tile 402 is connected to an adjacent floor tile 412 using a second tile connector 410. In these embodiments, the portion of the tile connector 414 extends into the tile cavity 416 of the floor tile 402 and a different portion of the tile connector 418 extends into the tile cavity of the adjacent floor tile 420.

In FIG. 4, in some embodiments, a tile floor edge piece 422 has six sides, where two sides can interlock with the array of the interlocked floor tiles which is adjacent to the tile floor edge piece 422 using the tile connector 410 (or second tile connector 410). One side of the tile floor edge piece 422 can interlock with at least one of the floor tiles in the array of the floor tiles and another side of the tile floor edge piece 422 can interlock with another one of the floor tiles in the array of the floor tiles.

Figure 6:
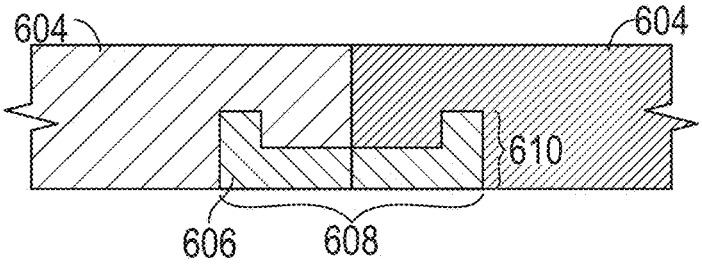
FIG. 6 is a cutaway depiction of the two modular tiles and connector from FIGS. 4 and 5, shown while connected.

Referring to FIG. 5 and FIG. 6, in some embodiments, the tile connector 506 (or second tile connector 506) is configured with various dimensions such as a connector length 508, a connector width 512, and a connector height 510 with a protrusion (e.g., 602 as illustrated in FIG. 6) on each end of the second tile connector 506. The tile slot 504 is formed at a bottom of the tile side 520. The tile slot 504 has a tile slot width and a tile slot thickness that compliments the connector width 512 and the connector thickness of the second tile connector 506, respectively. In some embodiments, a depth of the tile cavity (e.g., 416 as illustrated in FIG. 4) is equal to or less than half of the connector length 508 of the second tile connector 506. The tile cavity 516 contains a recess that complements a height of the protrusion 610 of the second tile connector 606. In an exemplary embodiment, if the connector length 508, 608 is 8 cm, the connector width 512 is 3 cm, the connector height 510 is 2 cm, and a height of the protrusion 610 is 0.5 cm, the tile slot width is 3 cm to match the connector width 512, and the tile slot thickness is shaped to complement the connector thickness at 1 cm. In some embodiments, the depth of the tile cavity 420 is crafted to be no more than half of the connector length 508, hence a maximum of 4 cm, facilitating a stable interlock. In some embodiments, the recess of the tile cavity 416 is configured to align with the 0.5 cm height of the protrusion 610 of the second tile connector 506, 606, thereby facilitating a secure and a precise engagement when the second tile connector 506 is inserted into the tile slot 504. In some embodiments, the tile cavity 416 of FIG. 4 and the tile cavity 216 of FIG. 2 are distinct from each other, since the tile cavity 416 has a recess feature.

In some embodiments, FIG. 6 illustrates the interlocking mechanism configured between two adjacent floor tiles 604 using the second tile connector 606. A cross-sectional view depicts the engagement of the second tile connector 606 with the tile slot (referenced, for example, as slot 504 in FIG. 5). The design or configuration ensures that the protrusion 610 on two ends of the second tile connector 606 are aligned with the recesses within the tile slot 504. These interlocking features extend the functionality and durability of the modular golf mat (e.g., 100 as illustrated in FIG. 1), with the engagement between the protrusion 506 and the recesses distributing force and reducing wear, thereby enhancing the longevity of the modular golf mat 100 through frequent and dynamic use.

In some embodiments, a hook-type connector (e.g., the second tile connector 506, 606 as illustrated in FIG. 5 and FIG. 6) is shaped to facilitate a secure and durable connection between individual floor tiles (e.g., 102 as illustrated in FIG. 1). In some embodiments, the hook-type connector is made from an elastic material, such as rubber, allowing the hook-type connector to stretch and contract to pull the hook edges closer, creating a tight interlock. In some other embodiments, a non-elastic, solid material may be employed for the hook-type connector, incorporating a spring mechanism centrally located within the hook. The spring may serve a similar purpose as the elastic material, providing a tensile force to maintain the integrity of the connection between the mats.

In some embodiments, for the tile slot (e.g., 112 as illustrated in FIG. 1) and insert mechanism, compatibility with a broad array of hook-type connector materials is possible. In some embodiments, the hook-type connectors increase friction upon insertion into the tile cavity (e.g., 216 as illustrated in FIG. 2 or 416 as illustrated in FIG. 4) may be more effective. By incorporating a textured surface into the hook-type connector configuration, made from materials such as, but not limited to, textured wood, plastic, or metal, there is an added benefit in resistance to slippage, facilitating a secure and stable union between the mat sections. This type of interlock mechanism between the hook-type connector and the tile slot 112 is more effective compared to, for example, adhesive-based materials and hook and loop materials, like VELCRO™. The adhesive-based materials are typically irreversible and do not support dissembling the interlock. The hook and loop materials tend to leave spacing between the mats unless the VELCRO™ is part of the insert, and even then, it may be really challenging to avoid gaps due to the resilient thickness (sponginess) of the VELCRO™ material.

In some embodiments, the hook-type connector engages with a corresponding tile slot, facilitating the individual floor tiles to interlock securely. Fabricated from an elastic material such as rubber, the hook-type connector may allow the protrusion edges to draw together and create a firm interlock when stretched and then released. For disassembly, this elastic property also permits the hooks to be stretched again, releasing the interlock without damage. In some embodiments utilizing a non-elastic, rigid material, a central spring mechanism within the hook compensates for the lack of elasticity by providing the necessary tensile force to maintain a secure connection. This spring mechanism allows for the hook-type connectors to be pushed together, compressing the spring, and then locked into place. Upon disassembly, releasing the spring tension enables the separation of the floor tiles. Both tile slots and the hook-type connectors provide for compatibility across a range of materials, with an emphasis on increasing friction during insertion to enhance the stability and durability of the interlocked floor tiles.

In some embodiments, the second tile connector (e.g., 606 as illustrated in FIG. 6), which may have protrusion 506 at two ends that are shaped like a square peg, round dowel, or any other geometric form, is shaped or configured to slide smoothly into a matching recess within the tile cavity (e.g., 416 as illustrated in FIG. 4). This interlocking provides a tight fit that resists lateral and vertical movement, providing a stable platform. For disassembly, the configuration allows for a reverse process where the second tile connector 606 may be withdrawn from the tile cavity 416 without excessive force or minimal shaking, allowing the floor tiles to be separated and reconfigured as desired. The assembly and disassembly process is typically straightforward, requiring minimal tools and effort, thus offering flexibility for various layouts and the convenience of portability.

Figure 7:
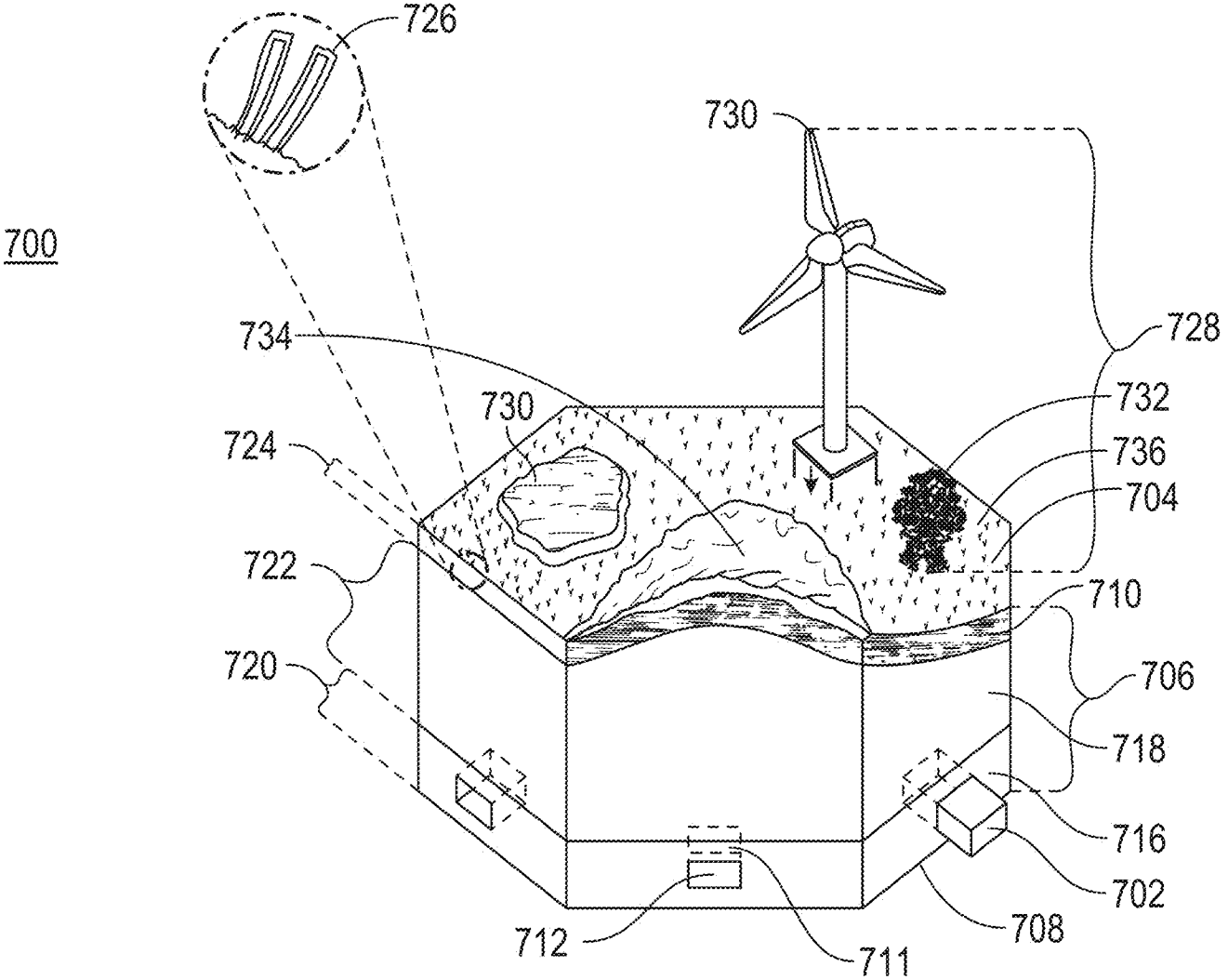
FIG. 7 is a schematic depiction of an embodiment of the modular golf mat with multiple layers and obstacles.

Referring to FIG. 7, in some embodiments, the floor tile 700 includes the base layer 716, a cushion or cushioning layer 718, and the grass layer 710. In some embodiments, the cushioning layer 718 is located between the base layer 716 and the grass layer 710. The base layer 716 has a tile bottom 708. In some embodiments, the base layer 716 is the foundation for the modular golf mat (e.g., 100 as illustrated in FIG. 1) and provides the structural integrity for the modular golf mat 100 to be carried and placed on the ground. In some embodiments, at least a portion of the base layer 716 is in contact with the cushioning layer 718. The cushioning layer 718 is in contact with a portion of the grass layer 710. In an exemplary embodiment, the base layer 716 has a base layer thickness 720 of from about 0.1 cm to about 6.0 cm, but not limited to this range. In some embodiments, the cushioning layer 718 is the layer that provides most of the variation in thickness and provides the shape and curves of the golf course. In an example embodiment, the cushioning layer 718 has a cushioning layer thickness 722 of about 0.1 cm to about 92.0 cm, but not limited to this range. In an example embodiment, the cushioning layer 718 has an average cushioning layer thickness 722 of from about 0.1 cm to about 92.0 cm. In some embodiments, the grass layer 710 replicates various types of turf found on the golf course such as the longer, denser grass or the shorter, smoother grass. In an example embodiment, the grass layer 710 has a grass layer thickness 724 of from about 0.1 cm to about 2.6 cm, but not limited to this range.

In some embodiments, the base layer 716 includes, but not limited to, wood, a foam, a foam composite, a plastic, a rubber, a polymer, or any combination thereof. In some embodiments, the foam-based materials may include, but not limited to, a polyurethane foam, an Ethylene-vinyl acetate (EVA), a closed-cell foam, a memory foam, a high-density foam, a polyethylene foam, a cross-linked polyethylene (XLPE), a composite foam with rubber or plastic additives for increased resilience, and the like. In some embodiments, the plastic-based materials may include, but not limited to, a high-impact polystyrene (HIPS), an acrylonitrile butadiene styrene (ABS), a polypropylene (PP), a polyvinyl chloride (PVC), a polycarbonate (PC), a high-density polyethylene (HDPE), and the like. In some embodiments, the rubber-based materials may include, but not limited to, a natural rubber, a Styrene-Butadiene Rubber (SBR), a neoprene, a nitrile rubber, an Ethylene Propylene Diene Monomer (EPDM) rubber, and the like. In some embodiments, the polymer-based materials may include, but not limited to, a nylon, Thermoplastic elastomers (TPE), a Thermoplastic urethane (TPU), a Polyvinyl Acetate (PVA), and the like.

In some embodiments, the cushioning layer 718 includes, but is not limited to, a silicone, a foam, a rubber, a particle infill, or any combination thereof. For the cushioning layer 718, the foam-based materials and the rubber-based materials may be same as used in the base layer 716. The silicone-based materials may include, but is not limited to, Liquid Silicone Rubber (LSR), Room Temperature Vulcanizing (RTV) silicone, silicone foam, and the like. The particle infill materials may include, but are not limited to, a crumb rubber (from recycled tires), thermoplastic microbeads, cork particles, polymeric beads, and the like.

In some embodiments, the grass layer 710 includes, but is not limited to, a polyethylene, a polypropylene, a nylon, or any combination thereof. In some embodiments, the grass layer 710 may be constituted by natural grass paired with an underlying soil layer. In some embodiments, grass layer can include the utilization of artificial turf composed of synthetic fibers. In some embodiments, these fibers are typically crafted from a polymer material, and are processed to create a textured, feather-like surface that closely mimics the tactile and visual properties of natural grass. In some embodiments, the tile top 704 of the floor tile 700 includes a coating layer 726 on top of at least a portion of the grass layer 710. In an example embodiment, the coating layer 726 has a thickness of about 0.02 cm to about 2.6 cm, but is not limited to this range. In some embodiments, the coating layer 726 includes, but is not limited to, a dye, a pigment, a paint coating, a protective coating, and the like.

In some embodiments, the base layer 716, the cushioning layer 718, the grass layer 710, and the coating layer 726 may be made up of bio-degradable-based materials. The bio-degradable materials for the base layer 716 may include, but are not limited to, biodegradable plastics derived from cornstarch, polylactic acid (PLA) composites, or natural fiber-based composites like jute, bamboo, or hemp, providing both durability and biodegradability. In some embodiments, the bio-degradable materials for the cushioning layer 718 may include, but not limited to, biodegradable foams made from natural latex, soy-based polyols, cellulose-based materials, and the like. In some embodiments, the bio-degradable materials for the cushioning layer 718 may include materials, which simulate the surface of a golf course such as, but not limited to, biodegradable artificial turfs made from PLA fibers or other compostable polymers, which mimic the feel and look of natural grass.

In some embodiments, the top side of the floor tile 700 includes an obstacle layer 728 that includes one or more objects 730 reversibly attached to the top surface 736 of the floor tile 700. In some embodiments, the one or more objects 730 are not fixed permanently, instead, the one or more objects 730 are designed to be movable, allowing the one or more objects 730 to be transferred easily from one floor tile to another floor tile. This flexibility enhances the versatility of the modular golf mat 100, enabling users to customize the layout and difficulty of their putting practice. By simply relocating these obstacles, users can create a variety of putting scenarios and challenges, adapting the course to different skill levels or training goals. This feature adds an element of dynamism and engagement to the golfing experience and also significantly increases the practical utility of the modular golf mat 100 for a diverse range of exercises and practice sessions.

Referring to FIG. 7, in some embodiments, a paint coating 732 may refer to a layer applied over the obstacle layer 728 of the floor tile 700. This paint coating 732 can be added for aesthetic purposes, thereby enhancing the visual appeal and mimicking the various conditions found on the golf course. The paint coating 732 may act as a protective barrier, safeguarding the modular golf mat 100 from wear and tear. In some embodiments, the paint coating 732 may have specialized properties, such as ultra-violet (UV) resistance or water repellence, to extend the durability of the golf mat 100. In some embodiments, raised portions 734 may create an uneven surface that mimics the varied terrain of the golf course. These raised portions 734 may provide the golfers with a more realistic practice experience, challenging the golfers to adapt to different lies and slopes as the golfers may find on an actual course. The raised portions 734 may facilitate in improving the skill of the golfer, thereby providing the opportunity for the golfers to practice different shots and approaches. In FIG. 7, the tile top is referred to as 704, the tile side is referred to as 706, the tile connector is referred to as 702 (e.g., 104 as illustrated in FIG. 1), and the tile slot is referred to as 712, and the tile slot opens to a tile cavity 711.

Method

Figure 8A:
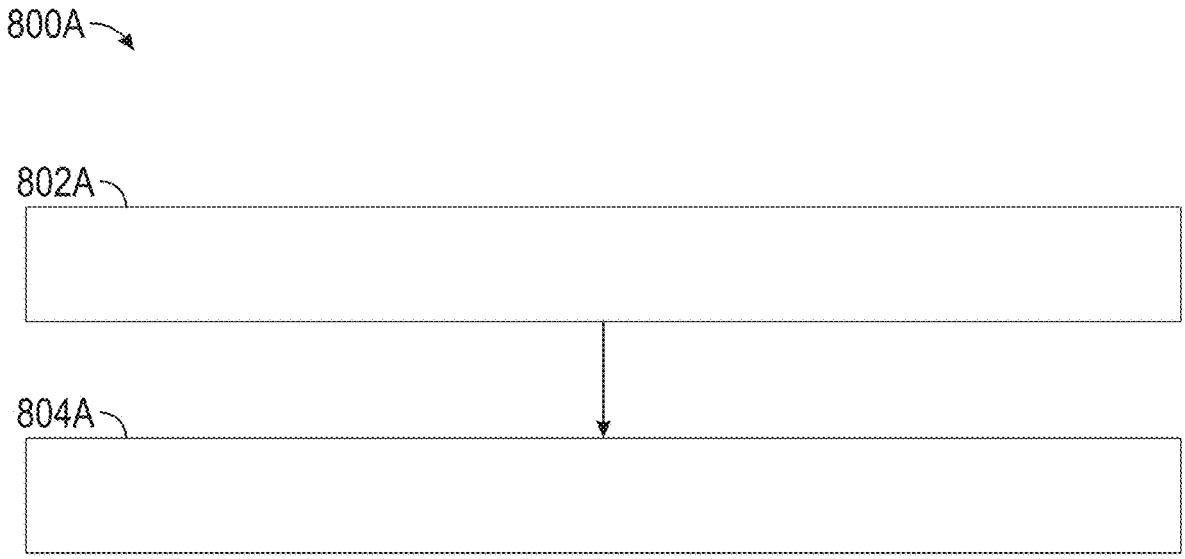
FIG. 8A and FIG. 8B are flow diagrams of some embodiments of methods of assembling the modular golf mat.
Figure 8B:
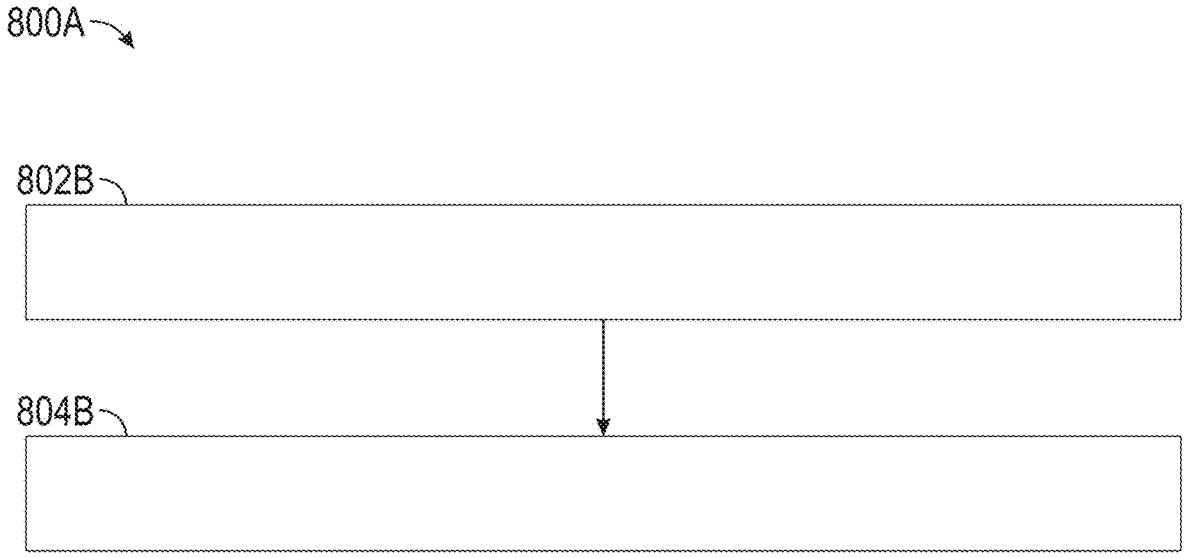

FIGS. 8A and 8B illustrate flow diagrams of an embodiment of methods 800A and 800B of assembling the modular golf mat (e.g., 100 as illustrated in FIG. 1), as disclosed herein. Referring to FIG. 8A, in some embodiments, at block 802A, the method 800A includes providing the floor tile (e.g., 102 as illustrated in FIG. 1) and the tile connector (e.g., 104 as illustrated in FIG. 1 or 506 as illustrated in FIG. 5). In some embodiments, the floor tile 102 has the tile top (e.g., 106 as illustrated in FIG. 1), the tile side (e.g., 108 as illustrated in FIG. 1), and the tile bottom (e.g., 110 as illustrated in FIG. 1). In some embodiments, the tile top 106 has a polygonal shape. In some embodiments, the tile top 106 includes the grass layer (e.g., 112 as illustrated in FIG. 1). In some embodiments, the tile side 108 has the tile slot (e.g., 112 as illustrated in FIG. 1) that opens to the tile cavity (e.g., 114 as illustrated in FIG. 1). In some embodiments, the tile cavity 114 has a shape complementary to a portion of the tile connector (e.g., 214 as illustrated in FIG. 2 or 414 as illustrated in FIG. 4).

Referring to FIG. 8A, at block 804A, the method 800A includes fastening a portion of the tile connector (e.g., 214 or 414) into the tile cavity 114 of the floor tile 102.

Referring to FIG. 8B, in some embodiments, at block 802B, the method 800B includes providing a second floor tile (e.g., the adjacent floor tile 212 as illustrated in FIG. 2 or the adjacent floor tile 412 as illustrated in FIG. 4). In some embodiments, the second floor tile (e.g., 212 or 414) has a second tile top, a second tile side, and a second tile bottom. In some embodiments, the second tile top has a second polygonal shape. The second polygonal shape may be the same as that of the tile top 106. In this embodiment, the second tile top, the second tile side, and the second tile bottom are referred to tile side, tile top, and tile bottom of the adjacent floor tile (e.g., 212 or 412). In some embodiments, the second tile top includes a second grass layer, which may be similar to the grass layer 112 in the tile top 106. In this embodiment, the second tile side has a second tile slot that opens to a second tile cavity having a shape complementary to a second portion of the tile connector (e.g., the different portion of the tile connector 218 as illustrated in FIG. 2 or the different portion of the tile connector 418 as illustrated in FIG. 4). In this embodiment, the second tile slot and the second tile cavity are referred to the tile slot, and tile cavity of the adjacent floor tile (e.g., 212 or 412). In this embodiment, the second polygonal shape (i.e., the polygon shape of the adjacent floor tile 212 or 412) matches the polygonal shape of the floor tile 102.

Referring to FIG. 8B, at block 804B, the method 800B includes assembling the modular golf mat 100 by fastening the second portion of the tile connector into the second tile cavity of the second floor tile. In this embodiment, the method 800B further includes forming the obstacle layer (e.g., 728 as illustrated in FIG. 7) by attaching the one or more obstacles (e.g., 730 as illustrated in FIG. 7) to the tile top 106, the second tile top, or any combination thereof.

Assembly and Methods

Embodiments of a method of assembling a modular golf mat are disclosed. In some embodiments, the method includes providing a floor tile and a tile connector, wherein the floor tile has a tile top, a tile side, and a tile bottom, wherein the tile top has a polygonal shape, wherein the tile top includes a grass layer, and wherein the tile side has a tile slot that opens to a tile cavity. In some embodiments, the method further includes fastening a portion of the tile connector into the tile cavity of the floor tile.

In some embodiments, the method further includes providing a second floor tile, wherein the second floor tile has a second tile top, a second tile side, and a second tile bottom, wherein the second tile top has a second polygonal shape, wherein the second tile top includes a second grass layer, wherein the second tile side has a second tile slot that opens to a second tile cavity, and wherein the second tile cavity has a shape complementary to a second portion of the tile connector. In some embodiments, the second polygonal shape matches the polygonal shape of the floor tile. In some embodiments, the method further includes assembling the modular golf mat by fastening the second portion of the tile connector into the second tile cavity of the second floor tile. In some embodiments, the method further includes forming an obstacle layer by attaching one or more obstacles to the tile top, the second tile top, or any combination thereof.

Embodiments of the modular golf mat assembly are disclosed. In some embodiments, the modular golf mat includes a floor tile and a tile connector, wherein the floor tile has a tile top, a tile side, and a tile bottom, wherein the tile top has a polygonal shape, and wherein the tile top includes a grass layer. In some embodiments, the tile side has a tile slot that opens to a tile cavity and the tile cavity has a shape complementary to a portion of the tile connector.

In some embodiments of the modular golf mat, the floor tile has 3, 4, 5, or 6 tile sides, or wherein the polygonal shape is a triangle, a rectangle, a rhombus, a pentagon, or a hexagon. In some embodiments, the tile bottom has a top polygonal shape selected from the group consisting of triangle, a rectangle, a rhombus, a pentagon, or a hexagon. In some embodiments, the polygonal shape of the tile top and the bottom polygonal shape of the tile bottom are the same or different.

In some embodiments of the modular golf mat, the tile bottom includes a base layer, and the floor tile includes a cushioning layer located between the base layer and the grass layer. In some embodiments, the tile bottom includes a base layer, wherein at least a portion of the base layer is in contact with the cushioning layer, and wherein the cushioning layer is in contact with a portion of the grass layer.

In some embodiments of the modular golf mat, the floor tile includes a base layer, a cushioning layer, and the grass layer. In some embodiments, the base layer has a base layer thickness of from about 0.1 cm to about 6.0 cm. In some embodiments, the cushioning layer has a cushioning layer thickness of from about 0.1 cm to about 92.0 cm. In some embodiments, the cushioning layer has an average cushioning layer thickness of from about 0.1 cm to about 92.0 cm. In some embodiments, the grass layer has a grass layer thickness of from about 0.1 cm to about 2.6 cm.

In some embodiments of the modular golf mat, the floor tile includes a base layer, a cushioning layer, and the grass layer, and the base layer includes wood, a foam, a foam composite, a plastic, a rubber, a polymer, or any combination thereof. In some embodiments, the cushioning layer includes a silicone, a foam, or a rubber, a particle infill, or any combination thereof. In some embodiments, the grass layer includes a polyethylene, a polypropylene, a nylon, or any combination thereof.

In some embodiments of the modular golf mat, the top side of the floor tile includes a coating layer on top of at least a portion of the grass layer, wherein the coating layer has a thickness of about 0.02 cm to about 2.6 cm. In some embodiments, the coating layer includes a dye, a pigment, a paint coating, or a protective coating.

In some embodiments of the modular golf mat, the top side of the floor tile includes an obstacle layer, and the obstacle layer includes one or more objects reversibly attached to the top surface of the floor tile.

In some embodiments of the modular golf mat, the modular golf mat includes an interlocking array of two or more floor tiles, wherein the two or more floor tiles have a tile top having a hexagonal shape and six tile sides having equal side lengths. In some embodiments, the floor tile is connected by the tile connector to an adjacent floor tile, wherein a portion of the tile connector extends into the tile cavity of the floor tile and a different portion of the tile connector extends into the tile cavity of the adjacent floor tile, In some embodiments of the modular golf mat, the tile connector has a connector length, a connector width, and a connector thickness, and the tile slot is located within the tile side, the tile slot has a slot width and slot thickness that compliments the connector width and connector thickness of the tile connector, and the depth of the tile cavity is equal to or less than half of the length of the tile connector.

In some embodiments of the modular golf mat, the tile connector has a connector length, a connector width, and a connector height with a protrusion on each end of the tile connector, and the tile slot is formed by a bottom of the tile side, the tile slot has a slot width and slot thickness that compliments the connector width and the connector thickness of the tile connector, and the depth of the tile cavity is equal to or less than half of the connector length of the tile connector, and the tile cavity contains a recess that complements a height of the protrusion of the tile connector.

In more detail,

Embodiment 1

A modular golf mat comprising a floor tile and a tile connector, wherein the floor tile has a tile top, a tile side, and a tile bottom, wherein the tile top has a polygonal shape, and the tile top includes a grass layer, wherein the tile side has a tile slot that opens to a tile cavity, and wherein the tile cavity has a shape complementary to a portion of the tile connector.

Embodiment 2

The modular golf mat of embodiment 1 and 3-10, wherein the floor tile has 3, 4, 5, or 6 tile sides, or wherein polygonal shape is a triangle, a rectangle, a rhombus, a pentagon, or a hexagon, or wherein a tile bottom has a top polygonal shape selected from the group consisting of triangle, a rectangle, a rhombus, a pentagon, or a hexagon, or wherein the polygonal shape of the tile top and the bottom polygonal shape of the tile bottom are the same or different.

Embodiment 3

The modular golf mat of any one of embodiments 1-2 and 4-10, wherein a tile bottom includes a base layer, and the floor tile includes a cushioning layer located between the base layer and the grass layer, or wherein the tile bottom includes a base layer, wherein at least a portion of the base layer is in contact with the cushioning layer, and wherein the cushioning layer is in contact with a portion of the grass layer.

Embodiment 4

The modular golf mat of any one of embodiments 1-3 and 5-10, wherein the floor tile includes a base layer, a cushioning layer, and the grass layer, and wherein the base layer has a base layer thickness of from about 0.1 cm to about 6.0 cm; or wherein the cushioning layer has a cushioning layer thickness of from about 0.1 cm to about 92.0 cm, or wherein the cushioning layer has an average cushioning layer thickness of from about 0.1 cm to about 92.0 cm, or wherein the grass layer has a grass layer thickness of from about 0.1 cm to about 2.6 cm.

Embodiment 5

The modular golf mat of any one of embodiments 1-4 and 6-10, wherein the floor tile includes a base layer, a cushioning layer, and the grass layer, and wherein the base layer includes wood, a foam, a foam composite, a plastic, a rubber, a polymer, or any combination thereof; or wherein the cushioning layer includes a silicone, a foam, or a rubber, a particle infill, or any combination thereof; or wherein the grass layer includes polyethylene, a polypropylene, a nylon, or any combination thereof.

Embodiment 6

The modular golf mat of any one of embodiments 1-5 and 7-10, wherein the top side of the floor tile includes a coating layer on top of at least a portion of the grass layer, and wherein the coating layer has a thickness of about 0.02 cm to about 2.6 cm, or wherein the coating layer includes a dye, a pigment, a paint coating, or a protective coating.

Embodiment 7

The modular golf mat of any one of embodiments 1-6 and 8-10, wherein the top side of the floor tile includes an obstacle layer, and the obstacle layer includes one or more objects reversibly attached to the top surface of the floor tile.

Embodiment 8

The modular golf mat of any one of embodiments 1-7 and 9-10, wherein the modular golf mat includes an interlocking array of two or more floor tiles, wherein the two or more floor tiles have a tile top having a hexagonal shape and six tile sides having equal side lengths, and wherein the floor tile is connected by the tile connector to an adjacent floor tile, wherein a portion of the tile connector extends into the tile cavity of the floor tile and a different portion of the tile connector extends into the tile cavity of the adjacent floor tile.

Embodiment 9

The modular golf mat of any one of embodiments 1-8 and 10, wherein the tile connector has a connector length, a connector width, and a connector thickness, and the tile slot is located within the tile side, the tile slot has a slot width and slot thickness that compliments the connector width and connector thickness of the tile connector, and the depth of the tile cavity is equal to or less than half of the length of the tile connector.

Embodiment 10

The modular golf mat of any one of embodiments 1-9, wherein the tile connector has a connector length, a connector width, and a connector height with a protrusion on each end of the tile connector, and the tile slot is formed by a bottom of the tile side, the tile slot has a slot width and slot thickness that compliments the connector width and the connector thickness of the tile connector, and the depth of the tile cavity is equal to or less than half of the connector length of the tile connector, and the tile cavity contains a recess that complements a height of the protrusion of the tile connector.

Embodiment 11

A method of assembling a modular golf mat comprising: providing a floor tile and a tile connector, wherein the floor tile has a tile top, a tile side, and a tile bottom, wherein the tile top has a polygonal shape, wherein the tile top includes a grass layer, and wherein the tile side has a tile slot that opens to a tile cavity, wherein the tile cavity has a shape complementary to a portion of the tile connector, and fastening a portion of the tile connector into the tile cavity of the floor tile.

Embodiment 12

The method of any one of embodiments 11 and 13, comprising: providing a second floor tile, wherein the second floor tile has a second tile top, a second tile side, and a second tile bottom, wherein the second tile top has a second polygonal shape, wherein the second tile top includes a second grass layer, and wherein the second tile side has a second tile slot that opens to a second tile cavity, wherein the second tile cavity has a shape complementary to a second portion of the tile connector, wherein the second polygonal shape matches the polygonal shape of the floor tile, and assembling the modular golf mat by fastening the second portion of the tile connector into the second tile cavity of the second floor tile.

Embodiment 13

The method of any one of embodiments 11 and 12, comprising: forming an obstacle layer by attaching one or more obstacles to the tile top, the second tile top, or any combination thereof.

EXAMPLES

The ideal golf mat would have a real feel turf to simulate putting greens while having the versatility to be rearranged for the user to adapt their play style to different setups. The base layer can have a variable thickness that the middle cushioning layer and top turf layer contour to so the user may design different slopes and lies for practice. A hexagonal-shaped mat would be suitable to provide users with a variety of choices on how they wish to arrange their mats and enable them to use other mats they possess to expand the playing surface. The turf between multiple mats would be level/flush to ensure a true roll is achieved. To be able to construct such a mat, the base layer would need to be solid and firm to ensure it doesn't cave under the weight of the user and alter the surface of the mat. The cushioning layer on top of the base layer would provide the user with a similar sensation as standing on a putting green. The turf would be of premium quality used by professionals so users can get real practice and improve their game. When constructed the layers need to be securely attached via adhesive, physical anchor such as a nail or a combination of both. The connector piece would be made from a sturdy material such as wood or composite that would seamlessly interlock and disassembly into cavities on the sides of the mat. Certain tile tops may have the ability to attach and detach obstacles on the surface of the mat.

Example 1

The base layer would be injection molded into hexagonal shapes with a slot located in each side of the base layer, as depicted in the drawings. The base layer can be made of an acrylonitrile butadiene rubber. A cushioning layer would be injection molded, independently of the base layer, to provide a desired shape and then the cushioning layer would be adhered onto the top of the base layer using an adhesive, such as epoxide. The cushioning layer would be a silicone, such as a PDMS (polydimethylsiloxane) available, such as SYLGARD™ 184 Silicone Elastomer Kit from DOW®. The grass layer would be commercially purchased from a vendor, such as HOME DEPOT® or Turf Factory (Dalton, GA), and then cut to fit the cushioning layer and adhered to the top of the cushioning layer by an adhesive, such as an epoxide. A coating layer would be added to the grass layer by spraying the grass layer with an aerosol paint or a what ability modifier, such as SCOTCHGARD® Fabric Water Shield (3M®). Wooden tile connectors could be placed into slots and adjacent floor tiles pushed together to assemble an interlocking array of two or more floor tiles.

Example 2

The process of fabricating the interlocking array of floor tiles would be the same as Example 1 with the following changes. After the injection molding step of the base layer, the base layer of multiple tiles would be pushed together without a tile connector, then a continuous cushioning layer would be molded and/or sculpted onto of all of the base layers to provide the shape of a famous or fanciful golf course, or a particular hole thereof. Then the individual tiles would be fabricated by cutting the cushioning layer along the edges of the underlying base layers to separate the tiles. The grass layer and/or coating layer would be adhered to the cushioning layer before, after, or during the cutting step. After separating the individual tiles, wooden tile connectors could be placed into slots and adjacent floor tiles pushed together to assemble an interlocking array of two or more floor tiles.

What is claimed is:

1. A modular golf mat, comprising:

a floor tile and a tile connector, wherein the floor tile has a tile top, a tile side, and a tile bottom, wherein the tile top has a hexagonal shape with six equal-length tile sides, each tile side including a tile slot opening to a tile cavity, wherein the tile top includes a grass layer, wherein the tile connector has a connector length, a connector width, and a connector height with a protrusion on each end, wherein the tile slot is formed along the bottom portion of the tile side and has a slot width and slot thickness that complements the connector width and the connector height of the tile connector, wherein the tile cavity has a shape complementary to a portion of the tile connector and contains a recess that complements a height of the protrusion of the tile connector, and wherein each of the six tile sides including the tile slot and the tile cavity, such that the tile connector interlocks adjacent tiles along any of the six tile sides in a non-linear, multi-directional array.

2. The modular golf mat of claim 1, wherein the tile bottom comprises a layered structure including, from bottom to top: a base layer, a cushioning layer disposed above the base layer, and a grass layer disposed above the cushioning layer.

3. The modular golf mat of claim 2, wherein: the base layer has a thickness of about 0.1 cm to about 6.0 cm; the cushioning layer has an average thickness of about 0.1 cm to about 2.0 cm; and the grass layer has a thickness of about 0.1 cm.

4. The modular golf mat of claim 2, wherein:

the base layer comprises one or more of wood, foam, plastic, rubber, or polymer;

the cushioning layer comprises one or more of silicone, foam, rubber, or particle infill; and the grass layer comprises one or more of polyethylene, polypropylene, or nylon.

5. The modular golf mat of claim 1, further comprising a coating layer on top of at least a portion of the grass layer, wherein the coating layer has a thickness of about 0.02 cm to about 1.0 cm and includes a pigment, paint, or protective material.

6. The modular golf mat of claim 1, further comprising an obstacle layer including one or more removable training features selected from foam bumpers, raised contours, or markers attached to the top surface of the floor tile.

7. The modular golf mat of claim 1, wherein the mat comprises an interlocking array of two or more floor tiles having a hexagonal tile top with six tile sides of equal length, and wherein each floor tile is connected by a tile connector extending into tile cavities of adjacent tiles, enabling connection in multiple directions including non-linear or angled tile orientations.

8. The modular golf mat of claim 1, wherein the tile slot and tile cavity are dimensioned such that the depth of the tile cavity is equal to or less than half of the length of the tile connector.

9. The modular golf mat of claim 1, wherein the tile cavity includes a recess that snugly fits the protrusion on each end of the tile connector to provide a mechanical interlock.

10. A method of assembling a modular golf mat, comprising:

providing a floor tile and a tile connector as defined in claim 1;

fastening a portion of the tile connector into the tile cavity of the floor tile.

11. The method of claim 10, further comprising:

attaching one or more removable training features to the tile top to form an obstacle layer.

12. The modular golf mat of claim 1, wherein each of the six tile sides includes an identical slot and cavity configuration to permit interlocking with adjacent tiles along any of the six directions.

* * * * *